United States Patent [19]

Jones et al.

[11] Patent Number: 5,032,249

[45] Date of Patent: Jul. 16, 1991

[54] FRACTIONATION PROCESS FOR PETROLEUM WAX

[75] Inventors: Richard L. Jones; Michael R. Mitchael, both of Katy, Tex.; Robert A. Krenowicz; W. Mark Southard, both of Ponca City, Okla.

[73] Assignee: Conoco Inc., Ponca City, Okla.

[21] Appl. No.: 574,836

[22] Filed: Aug. 28, 1990

[51] Int. Cl.[5] ..... L10G 73/00

[52] U.S. Cl. ..... 208/24; 208/347; 208/360

[58] Field of Search ..... 208/24, 347, 360; 203/72, 89; 159/6.2

[56] References Cited

U.S. PATENT DOCUMENTS

| | | | |
|---|---|---|---|
| 3,644,179 | 2/1972 | Knoer et al. | 203/72 |
| 4,171,981 | 10/1979 | Austin et al. | 106/14.5 |
| 4,235,458 | 11/1980 | Austin et al. | 282/27.5 |
| 4,941,967 | 7/1990 | Mannetie et al. | 208/360 |

FOREIGN PATENT DOCUMENTS

| | | | |
|---|---|---|---|
| 320135 | 10/1929 | United Kingdom | 208/360 |

*Primary Examiner*—Curtis R. Davis
*Assistant Examiner*—William L. Diemler
*Attorney, Agent, or Firm*—Cleveland R. Williams; Henry H. Huth

[57] ABSTRACT

Heavy intermediate petroleum wax is separated into two fractions in a wiped film evaporator to provide a lower boiling fraction of narrow melting range particularly suitable for use in hot melt adhesive formulations.

7 Claims, 1 Drawing Sheet

FRACTIONATION PROCESS FOR PETROLEUM WAX

BACKGROUND OF THE INVENTION

The petroleum industry generally classifies petroleum waxes in three main categories, namely (1) paraffins, (2) intermediate, and (3) microcyrstallines. Other classes of waxes include the scale waxes and slack waxes. Generally, in a commercial petroleum process the paraffin waxes comprise the 90, 200 and 350 distillate fractions from a vacuum distillation unit. These numbers represent Saybolt universal seconds, a measure of the distillate viscosity at 100° F. This wax is a mixture of solid hydrocarbons derived from the overhead wax distillate fraction obtained from the fractional distillation of petroleum crude oils. The paraffin wax, after purification, is a substantially colorless, brittle and low viscosity material normally having a melting point of from about 120° F. to about 160° F.

The heavy intermediate waxes are produced from the 650 distillate wax fraction of a vacuum distillation unit, e.g., Saybolt Universal seconds at 100° F. The temperature and pressure of the vacuum residue are optionally adjusted to distill off the 650 distillate wax fraction in the process herein. It should be noted that petroleum crude oils from different sources will have different optimum temperatures for distilling off the 650 distillate wax fraction. These heavy intermediate waxes have a melting point of from about 145° F. to about 185.F. and exhibit somewhat different physical properties than the individual paraffin waxes and microcrystalline waxes.

Microcrystalline waxes are conveniently produced from the nondistillable vacuum tower residues or resids from the fractional distillation of petroleum crude oils. These waxes differ from paraffin waxes in having branched hydrocarbons of higher molecular weight. They are considered more plastic than paraffin waxes, normally are dark colored or opaque, and usually have a melting point of from about 150° F. to about 200 F.

The categories of waxes described are obtained as by-products in the manufacture of lubricating oils. They are used for a number of purposes, such as, in the coating of a variety of substrates, in hot melt adhesives, in the manufacture of candles, and the like. Prior to such uses, they are ordinarily subjected to various finishing processes, such as bauxite or fullers earth percolation, hydrotreating, etc. to remove oxygenates, olefins and aromatic color causing compounds. The various categories of waxes are used alone or in combination in formulations which may include a variety of polymers, resins, anti-oxidants and other additives.

In the manufacture of hot melt adhesives, the desirable wax component has a high melting point and a relatively narrow melting range which offers good compatibility with the polymers and resins used in such adhesives. Heavy intermediate waxes have the requisite melting points but are usually of much wider melting range than is preferred for hot melt adhesives. Such waxes can be fractionated by conventional vacuum distillation to provide narrow melting range fractions, however, the temperatures required usually result in fractions containing undesirable degradation products which adversely affect the properties of the wax, in particular the color and odor.

THE PRIOR ART

U.S. Pat. Nos. 4,171,981 and 4,235,458 issued Oct. 23, 1979 and Nov. 25, 1980 respectively, relate to a hot melt coating composition and a process for the preparation of said coating composition.

In particular, the composition consists of a hot melt suspending medium having a melting point of from 50 C. to 150° C. and a microencapsulated chromogenic material. The hot melt suspending medium includes waxes and resins.

In a batch process, the hot melt suspending medium and microcapsules are mechanically mixed together in a closed environment, heated to a temperature above the melting point of the suspending medium and a vacuum is applied to the mixture. In the preferred form, the process is carried out in a wiped film evaporator operating under a vacuum.

THE INVENTION

Petroleum wax is separated into a lower boiling range fraction having a narrow melting range and a higher boiling range fraction having a wider melting range by subjecting the wax to fractionation in a wiped film evaporator.

In one aspect of the invention, a lower boiling range wax fraction having a narrow melting range particularly suitable for use in hot melt adhesive formulations is obtained by subjecting a heavy intermediate petroleum wax to fractionation in a wiped film evaporator and recovering the aforesaid lower boiling range wax fraction having a narrow melting range and a higher boiling range wax fraction having a wider melting range.

DETAILED DESCRIPTION OF THE INVENTION

Figure 1:
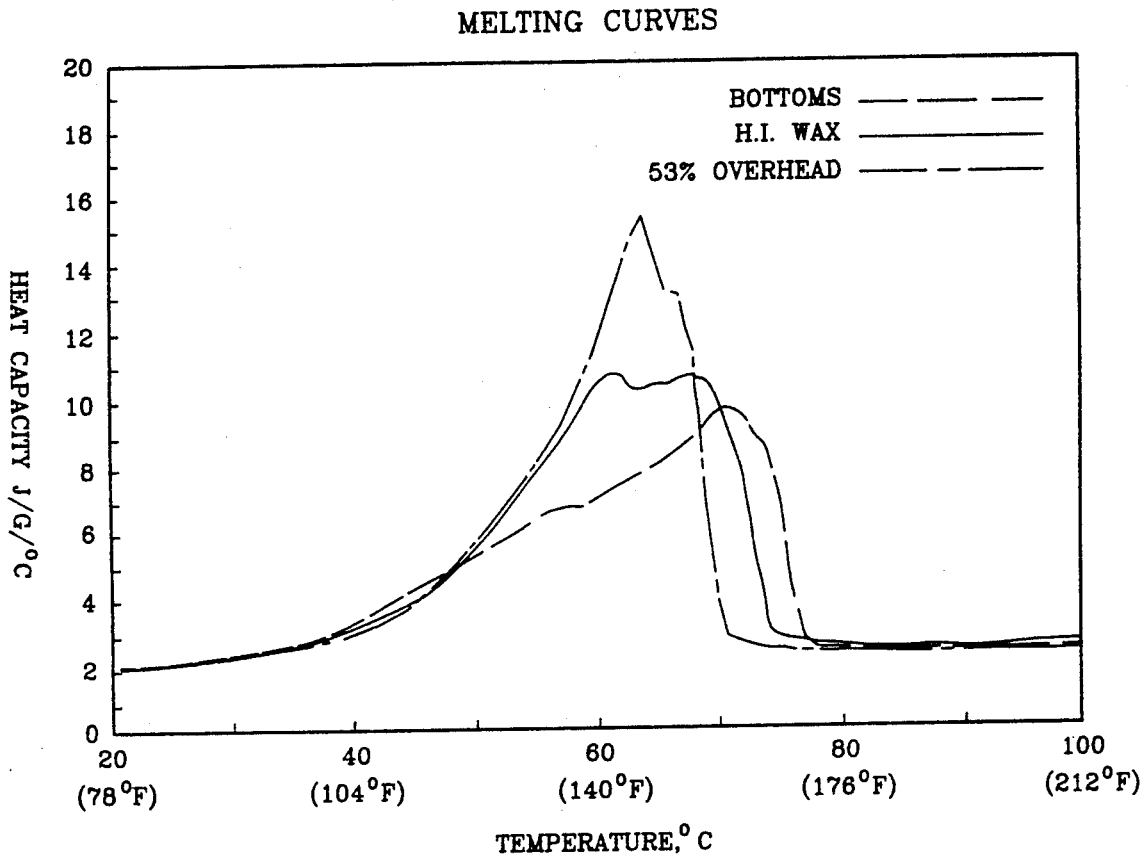
FIG. 1 is a plot which illustrates the melting curves for the feed, overhead and bottoms from a wiped film evaporation fractionation of a heavy intermediate wax.

Wax fractionation in a wiped film evaporator as carried out in the process of the invention, removes the lower boiling components of the wax overhead and provides a product having a narrow range of melting point. Since petroleum wax is comprised of a large number of individual hydrocarbons having different boiling points, a wax fraction when subjected to heat melts over a range of temperatures varying from the temperature of the lowest melting point component to the temperature of the highest melting weight component. Thus, the "melting range" of a wax is the range of melting temperature from the temperature of the lowest melting component of the wax to the temperature of the highest melting component. The "melting point" of a wax on the other hand is the temperature at which the entire wax fraction, e.g., paraffin, intermediate or microcrystalline wax, reaches the molten state. This temperature usually is at the melting point of the highest melting component of the wax fraction. A lower boiling wax fraction having a narrow range of melting temperatures has improved functional properties for applications such as hot melt adhesive formulations.

The advantage of wax fractionation is that it may be used safely with materials such as waxes which are sensitive to thermal degradation. Thus, the principal advantage of this form of distillation is the short time that the wax is exposed to temperatures where extensive decomposition could occur. Typical residence times in a wiped film evaporator are two to three minutes whereas much longer times are common in standard distillation columns or batch stills.

The lower level of thermal degradation available with a wax obtained from wiped film evaporation provides a product which requires less finishing to yield a marketable material. Finishing processes include bauxite or fullers earth percolation, hydrotreating and other options. Finishing the wax has the general objective of removing oxygenates, olefins and aromatic color causing compounds which reduce the customer appeal of waxes.

The wax grades with high melting points are the preferred starting materials for wiped film evaporator fractionation for two reasons: (1) high melting grades of wax typically have high value in the marketplace, (2) high melting point waxes are more likely than low melting point waxes to produce thermal degradation products as a result of the relatively high temperatures required for fractionation. The low boiling narrow melting range wax products obtained from wiped film evaporation are useful in such markets as hot melt adhesives where the wax is blended with thermoplastic polymers and tackifying resins. Reducing the boiling range and narrowing the melting range of the wax product generally increases the crystallinity of the wax. A narrow melting range wax of high crystallinity also offers good compatibility with the blending agents used in adhesives.

In carrying out the process of the invention, a wax feed is heated to an elevated temperature sufficient to melt the wax and make it flowable, usually between about 150° F. and about 250° F. depending on the particular composition of the wax feed. The molten wax is introduced to a wipe film evaporator wherein it is heated to a higher temperature sufficient to vaporize a portion of the wax, which is recovered as a lower boiling range fraction having a narrow melting range leaving a heavier residue wax of higher boiling range and wider melting range as the unvaporized product.

Wiped film evaporators are generally tubular in construction with the evaporating section of the tube being equipped with rotating wiper blades. The wiper blades may contact the cylindrical walls of the evaporator or there may be a slight gap in the order of several thousands of an inch between the wiper blades and the wall. The wiper blades may contains slots or holes through which liquid and vapor is free to pass. In the wiped film evaporator, a thin film of liquid to be treated is formed on the cylinder wall by the centrifugal action and wiping of the rotating blades. The rotating blades continuously agitate the film material being treated and keep it in a turbulent condition as it passes through the evaporating section. Treatment times in the evaporator may be in the order of a few seconds up to several minutes of duration. The heat necessary for the vaporization of the lower boiling fraction of the wax is applied through the walls of the evaporator and is usually supplied by steam. Thus, the temperature of the material being fractionated can be maintained at the desired temperature by controlling the temperature of the applied heat.

Wiped film evaporators are available from a number of manufacturers. The process of the invention may be carried out in either vertical or horizontal wiped film evaporators; however, vertical evaporators are preferred since they are usually operated with shorter residence times.

While any petroleum wax or wax fraction may be processed in a wiped film evaporator to obtain a lower melting narrow boiling range wax product, the feed material preferred in the process of the invention is obtained from the heavy intermediate waxes previously described.

The operating conditions employed in carrying out distillation in the wiped film evaporator will vary depending on the particular wax feedstock. When processing heavy intermediate petroleum wax, the top temperature of the evaporator will usually be from about 500° F. to about 600° F. and the bottom temperature will range from about 530° F. to about 660° F. The distillation is carried out under pressures which may vary from as low as 0.1 millimeters of mercury absolute to as high as 10 millimeters of mercury absolute. The residence time of the wax feed in the wiped film evaporator is preferably as short as possible to avoid subjecting the wax to high temperatures for a period of time which would cause degradation of the wax. Usually, the residence time will be from about 0.5 to about 4 minutes when processing a heavy intermediate petroleum wax.

The feed rate to the wiped film evaporator will of course depend on the size of the evaporator. In any event, the feed rate is controlled to provide the short residence time necessary to avoid degradation of the wax during the fractionation process.

When processing a heavy intermediate wax, the overhead from the evaporator may be controlled to provide a yield usually from about 20 to about 80 weight percent of the feed with the overhead product having a melting range of between about 100 F. and about 140° F. to between about 100° F. and about 170° F.

The process of the invention has been particularly described with reference to the use of heavy intermediate wax as a starting material; however, both lighter and heavier wax fractions may also be processed in a similar manner, with the operating parameters adjusted to accommodate either a lighter or a heavier wax feed to the wiped film evaporator.

The following example is presented in illustration of the invention.

EXAMPLE

A heavy intermediate petroleum wax was processed in a wiped film evaporator at an absolute pressure of 0.7 millimeter of mercury and a bottom temperature of 640° F. The feed rate to the wax film evaporator was 45 pounds per hour and the top temperature of the evaporator was 535° F. The residence time of the wax in the evaporator was approximately 2 minutes. The evaporator used was a vertical Pfaudler evaporator having an area of 1.4 square feet and containing carbon slotted blades. The blades which made contact with the inner wall of the evaporator were rotated at 300 rpm. The portion of the wax feed which was vaporized in the evaporator passed through an entrainment baffle was condensed and drained off to a receiver. The portion of the wax which was not vaporized collected in a weir at the bottom of the evaporator and was drained to a separate receiver. The properties of the feed wax and the overhead and bottoms product and the product yields are set forth in Table 1.

TABLE 1

| Test Description | Feedstock | Overhead Product | Bottoms Product |
|---|---|---|---|
| Yield, wt. % | NA | 53 | 47 |

TABLE 1-continued

| Test Description | Feedstock | Overhead Product | Bottoms Product |
|---|---|---|---|
| Congealing Point, °F. (ASTM D938) | 162 | 154 | 165 |
| Color, ASTM, Melt (ASTM D1500) | L0.5 | L1.5 | L3.5 |
| Dropping Point, °F. (ASTM D127) | 165 | 158 | 171 |
| Kinematic Viscosity, cSt, at 212° F. (ASTM D445) | 7.52 | 5.86 | 9.26 |
| Needle Penetration, 1/10 mm at 77° F. (ASTM D1321) | 15 | 19 | 17 |
| Oil Content, wt % | 2.00 | 3.55 | 2.17 |

The data in the Table confirms that wiped film evaporator fractionation can be accomplished on heavy intermediate wax at overhead yields of at least 53%. As shown in the Table, the color of the overhead product and the bottoms product was not as good as the feedstock, however, this is probably a result of the fact that the wiped film evaporator previously had been operated in petroleum pitch service and the residue from such service had not been completely removed.

Melting point curves for the feedstock overhead product and bottoms produce were obtained and are set forth in FIG. 1.

It is noted from the FIGURE that the feedstock and bottoms product both have relatively flat heat capacity curves and a relatively wide range of melting point. The overhead product on the other hand has a narrower range of melting point and its peak shows a high concentration of materials of high crystallinity melting over a very small temperature range.

While certain embodiments and details have been shown for the purpose of illustrating the present invention, it will be apparent to those skilled in the art that various changes and modifications may be made herein without departing from the spirit or scope of the invention.

We claim:

1. A process which comprises separating a petroleum wax into a lower boiling wax fraction of a narrow melting range and a higher boiling wax fraction of wider melting range by subjecting the petroleum wax to distillation in a wiped film evaporator.

2. The process of claim 1 in which the petroleum wax is a heavy intermediate petroleum wax.

3. The process of claim 2 which the petroleum wax has a melting point of from about 145° F. to about 185° F.

4. A process for obtaining a lower boiling petroleum wax fraction of narrow melting range suitable for use in hot melt adhesive formulations from a higher boiling heavy intermediate petroleum wax of a wider melting range which comprises subjecting said heavy intermediate petroleum wax to distillation in a wiped film evaporator at a temperature sufficient to vaporize the lower boiling fraction of said wax and condensing the lower boiling fraction to obtain said narrow melting range wax fraction.

5. The process of claim 1 in which the wiped film distillation is carried out at an evaporator bottom temperature of from about 530° to about 660° F. and a pressure of about 0.1 to about 10 millimeters of mercury absolute.

6. The process of claim 5 in which the melting point of the heavy intermediate petroleum wax varies from about 145° F. to about 185° F.

7. The process of claim 6 in which the melting range of the lower boiling wax fraction varies from between about 100 and about 170° F.

* * * * *